US005221041A

United States Patent [19]

Stout et al.

[11] Patent Number: 5,221,041

[45] Date of Patent: Jun. 22, 1993

[54] CARRIER HANDLE STRUCTURE

[75] Inventors: James T. Stout, Ellijay; James B. DeMaio, Marietta, both of Ga.

[73] Assignee: The Mead Corporation, Dayton, Ohio

[21] Appl. No.: 967,288

[22] Filed: Oct. 27, 1992

[51] Int. Cl.[5] ..... B65D 5/46

[52] U.S. Cl. ..... 229/117.13; 206/141

[58] Field of Search ..... 229/117.12, 117.13; 206/141, 161, 162, 428

[56] References Cited

U.S. PATENT DOCUMENTS

| | | | |
|---|---|---|---|
| 3,994,432 | 11/1976 | Kirby, Jr. | 229/117.13 |
| 4,172,546 | 10/1979 | Oliff et al. | 206/427 X |
| 4,378,905 | 4/1983 | Roccaforte | 229/117.12 |
| 4,538,759 | 9/1985 | Dutcher | 206/427 X |
| 4,588,084 | 5/1986 | Holley, Jr. | 206/428 X |
| 4,817,866 | 4/1989 | Wonnacott | 206/141 X |
| 4,860,944 | 8/1989 | Wonnacott | 206/141 X |
| 5,119,985 | 6/1992 | Dawson et al. | 229/117.13 |

*Primary Examiner*—Allan N. Shoap
*Assistant Examiner*—Christopher McDonald
*Attorney, Agent, or Firm*—Rodgers & Rodgers

[57] ABSTRACT

The invention applies to an article carrier handle structure for a carrier having top, bottom and side walls foldably joined to form a tubular arrangement. The handle structure is struck from the top wall of the carrier and includes a main handle flap together with a minor handle flap and a reinforcing strip. The main and minor handle flaps and the reinforcing strip are constructed in such manner that a five ply handle structure is provided so as to form an unusually sturdy mechanically strong handle.

9 Claims, 4 Drawing Sheets

CARRIER HANDLE STRUCTURE

TECHNICAL FIELD

This invention pertains to article carriers which are mechanically strong so as to accommodate packaging of a plurality of heavy articles.

BACKGROUND ART

U.S. Pat. application Ser. No. 950,006 filed Sep. 3, 1992 and owned by the assignee of this invention discloses and claims a carrier for use in packaging a plurality of heavy articles and preferably incorporates handle structure which is the same or similar to that provided according to this invention.

SUMMARY OF THE INVENTION

According to this invention in one form, a heavy duty article carrier is provided with mechanically strong handle structure which includes a main handle flap struck from the top wall of the carrier and foldably joined thereto along at least a pair of fold lines together with at least one minor handle flap struck in part from the top wall and in part from the main handle flap, said minor handle flap being foldably joined to said top wall along a single fold line spaced transversely from said pair of fold lines, said main handle flap and said minor handle flap being foldable inwardly to cause said minor handle flap to be in flat face contacting relation with said major flap and with the inner surface of said top wall to form a triple thickness handle structure.

According to one form of the invention, a five ply handle is provided in an arrangement having inner and outer overlapped panels and a reinforcing strip struck from an inner top wall panel and disposed in flat face contacting relation therewith and with an outer or upper top wall panel to form a three panel strut for the carrier which may be used in conjunction with one of said main handle flaps and an associated one of said minor handle flaps to form a five ply handle structure.

BEST MODE OF CARRYING OUT THE INVENTION

Figure 1:
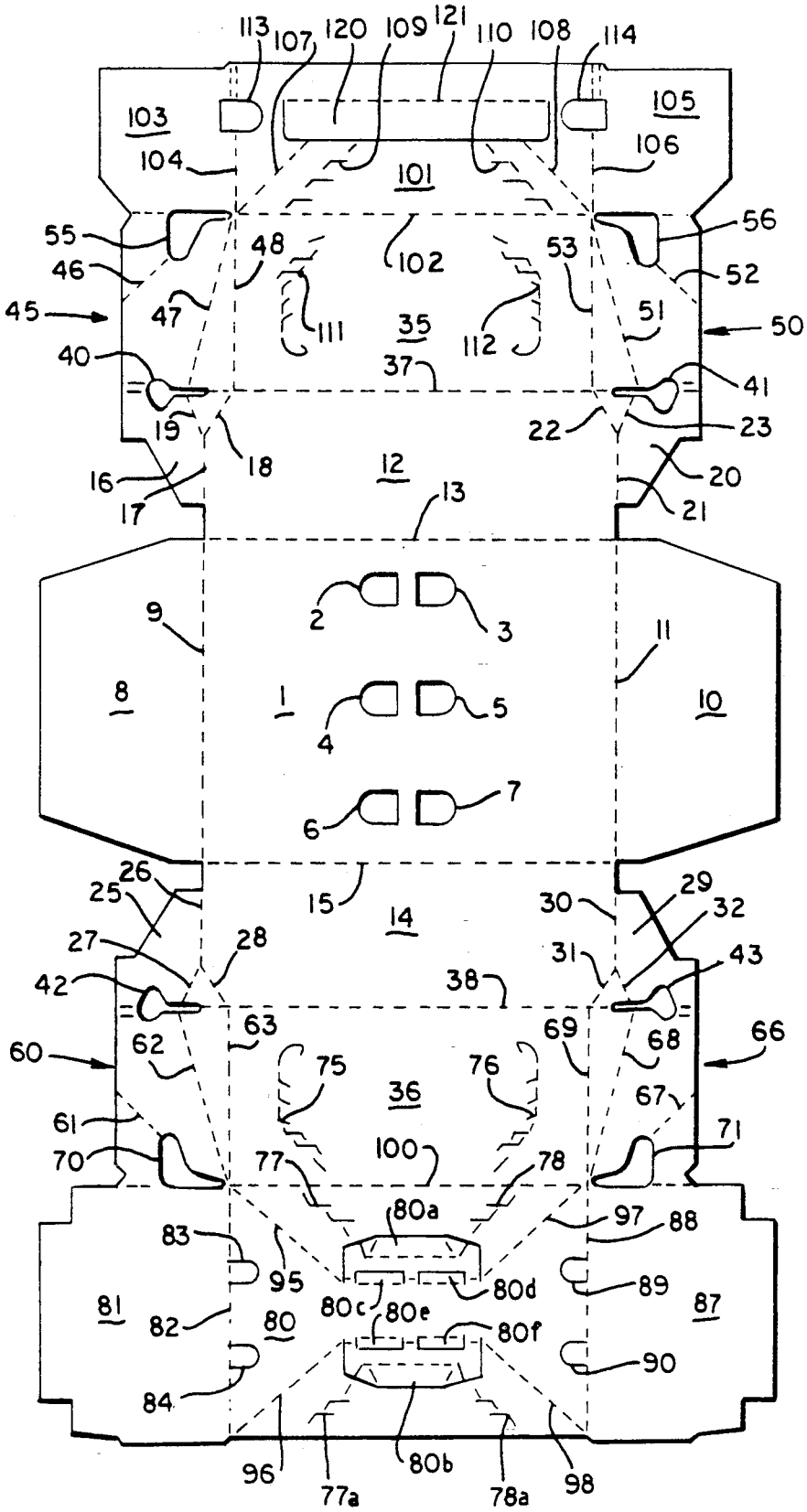
FIG. 1 is a view of the inner surface of a blank which is formed according to this invention.

In the drawings, numeral 1 designates the bottom wall of the carrier in which a plurality of apertures 2–7 inclusive are formed and which cooperate with machine elements in a manner which is well known. An end flap 8 is foldably joined to bottom wall 1 along fold line 9 while an end flap 10 is foldably joined to bottom wall 1 along fold line 11.

A side wall 12 of the carrier is foldably joined to the bottom wall 1 along a fold line 13 and side wall 14 is foldably joined to bottom wall 1 along fold line 15.

As is more fully explained in the aforementioned pending patent application, end flap 16 is foldably joined to side wall 12 along fold line 17 and a pair of fold lines 18 and 19 define two sides of a triangular area which interconnects end panel 16 and side wall 12. At the other end of the carrier, end flap 20 is foldably joined to side wall 12 along fold line 21 and a pair of fold lines 22 and 23 are arranged to define two sides of a triangular structure which interconnects the flap 20 to the side wall 12.

In like fashion, end flap 25 is foldably joined to an end edge 26 of side wall 14 and a pair of fold lines 27 and 28 define two sides of a triangular structure which is interconnected between side wall 14 and end flap 25. At the other end of the carrier, an end flap 29 is foldably joined to side wall 14 along fold line 30 and a pair of fold lines 31 and 32 are arranged to define two sides of a triangular structure which interconnects end flap 29 with side wall 14.

The form of this invention which is shown in the drawings is such that the lower portions such as 12 and 14 of the side walls are vertically disposed and the upper portions of each side wall such as 35 and 36 are inclined inwardly and upwardly from the fold lines 37 and 38 by which the upper portions 35 and 36 are interconnected with the lower portions 12 and 14 of the side walls.

Cutaway areas 40, 41, 42 and 43 are formed in the end structure as shown. Upper end flap 45 includes fold lines 46, 47 and the end edge of the upper inclined portion 35 is defined by the fold line 48. At the other side of the blank, end closure 50 includes fold lines 51 and 52. The end edge of inwardly and upwardly inclined panel 35 is designated by the numeral 53. Cutaway areas 55 and 56 are formed as best shown in FIG. 1.

End closure flap 60 includes fold lines 61 and 62 and the end wall of the upper portion of the side wall is designated by the numeral 63. On the other side of the carrier, the end flap 66 includes fold lines 67 and 68 and the end of the inwardly inclined side wall portion 36 is defined by the numeral 69. Cutaway areas 70 and 71 are formed in the end closure structure as best shown in FIG. 1. Tear strips 75 and 76 are formed in side wall panel 36 and are of known construction. These tear strips extend into top wall panel 80 as indicated at 77 and 78. End closure flap 81 is foldably joined to top wall panel 80 along fold line 82 and apertures 83 and 84 are formed in top wall 80 as indicated in FIG. 1.

The other end of the structure is indicated by the numeral 87 which is an end closure panel foldably joined along fold line 88 to top wall panel 80. Apertures 89 and 90 are formed in the panel 80 adjacent the fold line 88.

Yieldable lines 95, 96, 97 and 98 are formed in top wall 80 and severable tear lines **77*a* and 78*a* are also formed in top wall 80. Top wall 80 is foldably joined to side wall panel 36 along fold line 100**.

The top wall 80 and associated structure is arranged to cooperate with the inner top wall panel 101 which is foldably joined to side panel 35 along fold line 102. End flap 103 is foldably joined to an end edge 104 of panel 101. At the other end of the blank, end panel 105 is foldably joined to panel 101 along fold line 106. Yieldable fold lines 107 and 108 are formed in panel 101 and severable tear structure 109 and 110 are formed in panel 101 and function in known manner to facilitate opening the carton. Tear strips 111 and 112 are formed in panel 35 and function in known manner to facilitate opening of the carton. Apertures 113 and 114 are formed partially in the end portions of inner top panel 101 and extend into the end closure flaps 103 and 105 as is obvious. According to one feature of this invention, a reinforcing strip 120 is struck from inner top wall panel 101 and foldably joined to that panel along fold line 121.

Figure 2:
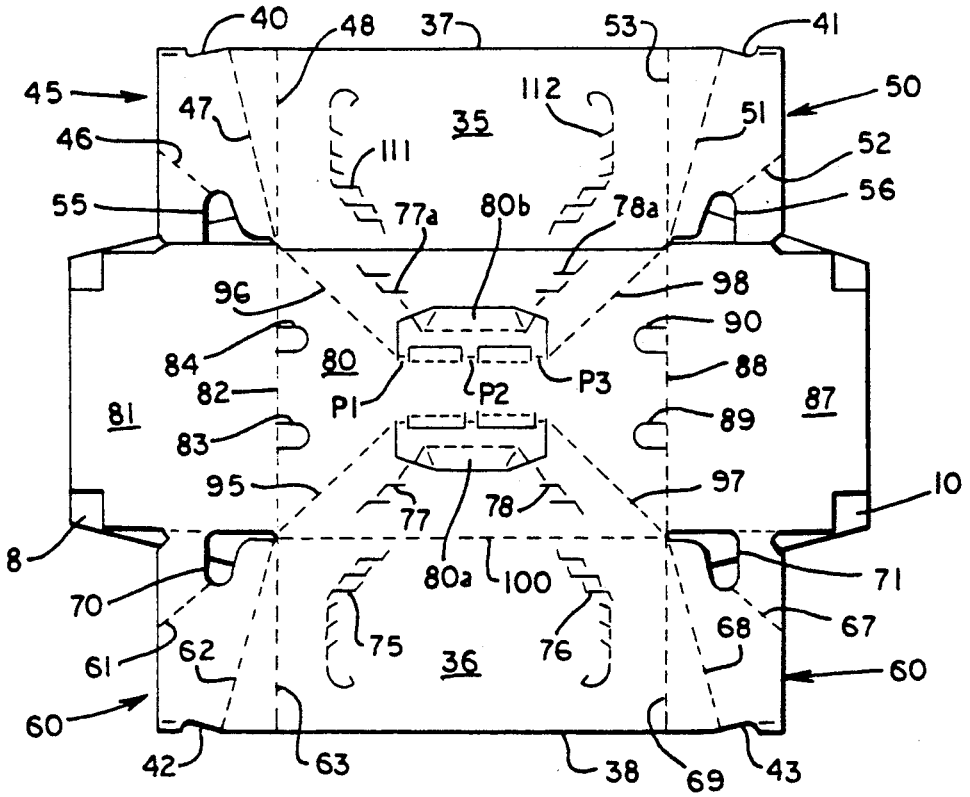
FIG. 2 is a view from above of the structure of FIG. 1 when folded and glued into a flat collapsed arrangement.

In order to manipulate the blank as shown from the inside in FIG. 1 into the collapsed condition shown in FIG. 2, an application of glue is made to reinforcing strip 120 as indicated by stippling in FIG. 1. Thereafter reinforcing strip 120 is elevated and folded forwardly along the fold line 121 so as to cause the reinforcing strip to become adhered to the inner portion of panel 101.

Thereafter panels 35, 101 and all of the end closure structure for these panels are elevated and folded forwardly along the fold line 37. An application of glue is then made to panels 101, 103 and 105. An application of glue is made to the inner surfaces of top wall 80 as indicated by stippling in FIG. 1. Simultaneously the panels 36 and 80 together with the end closure structure for those panels are elevated and folded forwardly along fold line 38 to bring the top wall panel 80 into face contacting relation with the inner top wall panel 101. This action also causes the end flaps 81 and 87 to become adhered to the end flaps 103 and 105 and the carton then appears as shown in FIG. 2.

Figure 3:
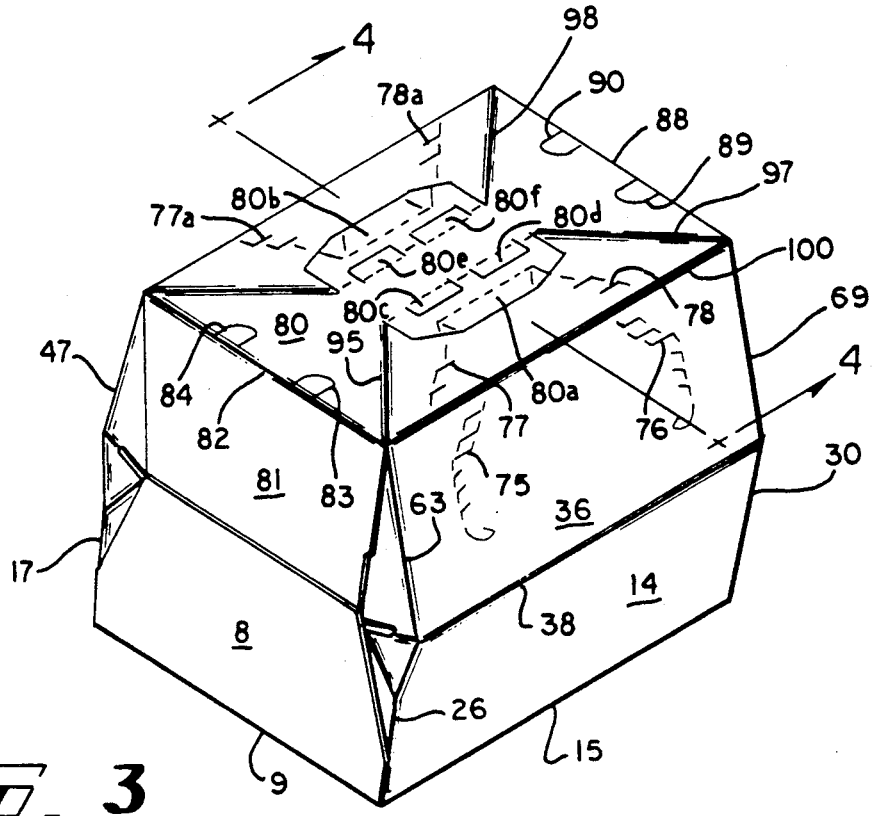
FIG. 3 is a set up fully loaded and closed carrier formed from the structure shown in FIGS. 1 and 2.

The carton as shown in FIG. 2 is in collapsed condition as is obvious and thus is in a form which facilitates shipment and handling prior to loading. After loading is accomplished, the carton appears as shown in perspective in FIG. 3.

Figure 4:
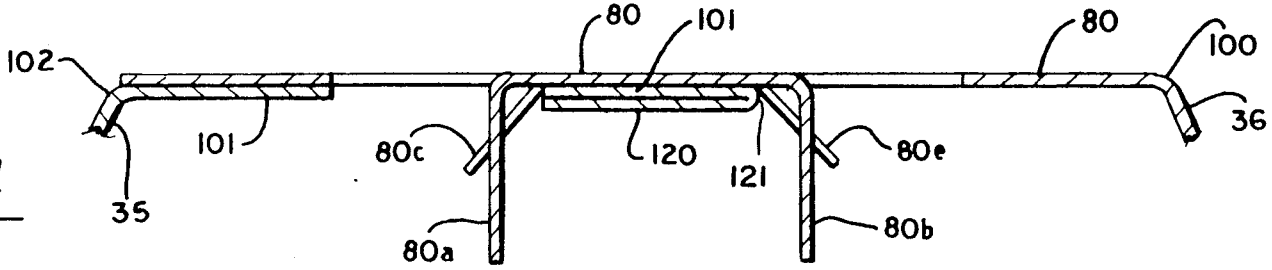
FIG. 4 is simply taken along the line designated 4—4, as indicated in FIG. 3.

As best shown in FIG. 4, the major handle flaps **80*a* and 80*b* are folded downwardly into approximately perpendicular relationship with the top wall panel 80. Major flaps 80*a* and 80*b* are supported by small projections such as P1, P2 and P3. Reinforcing strip 120 the inner panel 101, and the minor reinforcing tabs 80*c* and 80*e* are shown in FIG. 4. Minor reinforcing flaps 80*c* and 80*e* are shown in their partially folded condition as occurs during the inward movement of these flaps applied by the fingers of the user which also fold the major flaps 80*a* and 80*b* inward while also folding the minor flaps 80*c*, 80*d*, 80*e* and 80*f* inwardly. As is apparent from FIG. 1 the fold lines for the minor flaps 80*c* and 80*d*,80*e* and 80*f* are spaced inwardly toward the longitudinal center of panel 80. The three short transverse elements by which major handle flaps 80*a* and 80*b* are foldably joined to top wall 80 secure the major flaps 80*a* and 80*b* which major flaps are held in the plane of panel 80 by severable elements which are well known in the art and which constitute practical extensions of the tear lines 77, 78, 77*a* and 78*a*. Of course any suitable known structure for maintaining the major and minor flaps in the plane of top wall 80 may be used as may be desired. As is apparent from FIGS. 4 and 5, the reinforcing strip 120** is disposed immediately underneath the longitudinal center line strut so as to afford mechanical strength to the carrier when carried manually.

Of course the reinforcing strip 120 when folded upwardly and over into face contacting relation with the portion of the top wall 101 provides two plys of the medial strut of the carrier while the portion of top panel 80 which lies between the major flaps **80*a* and 80*b* constitutes a third ply. In addition, the major flaps such as 80*a* and 80*b* function in conjunction with the minor flaps 80*c*,80*d*, 80*e* and 80*f*** to provide an additional two reinforcing plys for the handle thus providing for a handle having five thicknesses.

Figure 5:
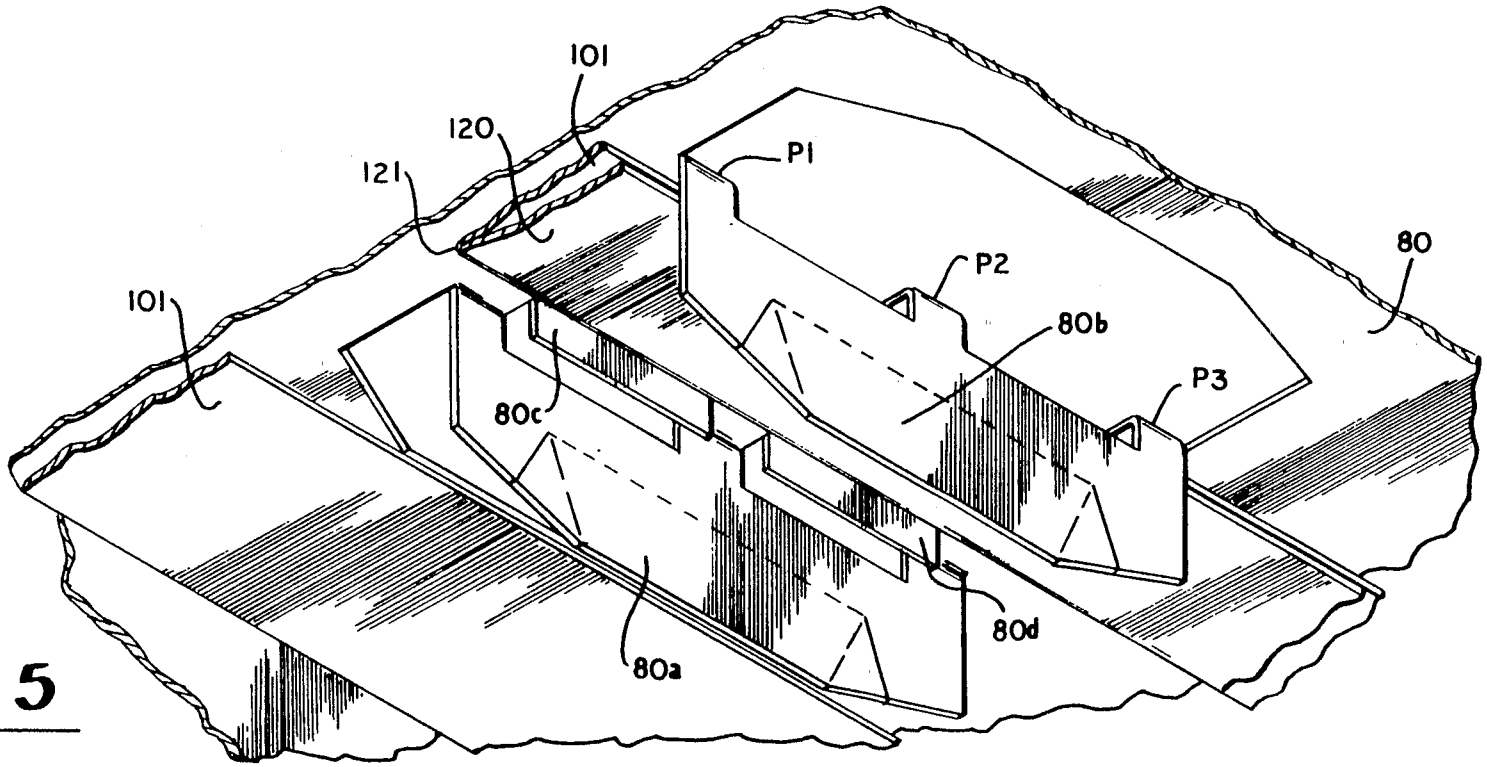
FIG. 5 is an enlarged fragmentary view of a portion of the carrier as viewed through one open end and which shows the handle components in partially set up condition.

FIG. 5 shows the elements of FIG. 4 during folding.

Figure 6:
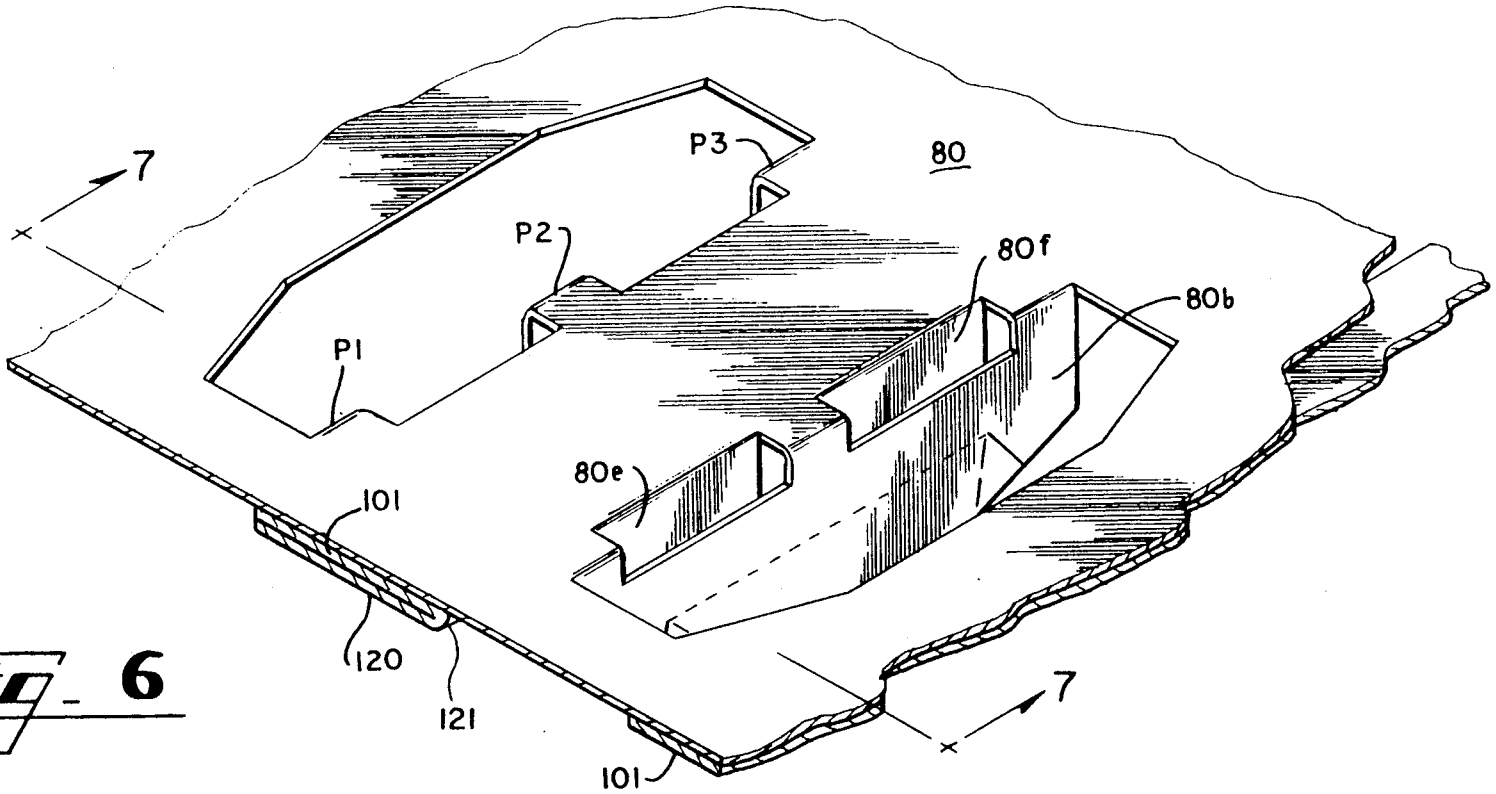
FIG. 6 is an enlarged fragmentary view of the handle structure with the main flaps and with minor handle flaps in partially folded positions and FIG. 7 shows flaps in fully folded positions.
Figure 7:
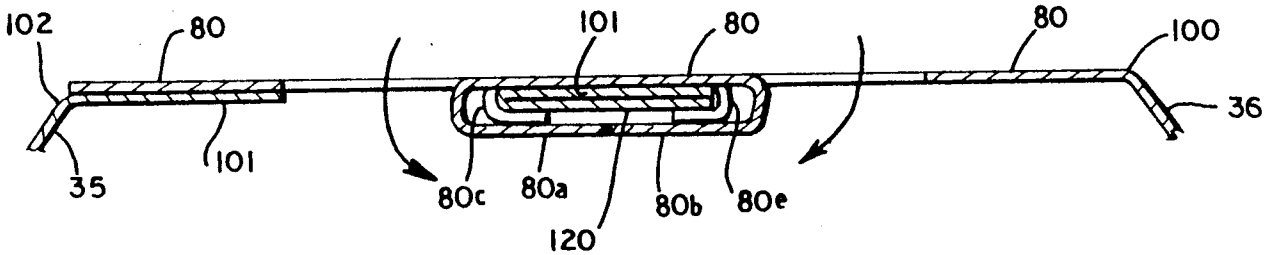

FIG. 6 shows the main and minor flaps in partially folded positions and FIG. 7 shows all the flaps in fully folded condition and with the reinforcing strip 120 folded into flat face contacting relation with the inner surface of top wall 80.

We claim:

1. Handle structure for an article carrier having top, bottom and side walls foldably joined to form a tubular arrangement, said structure comprising a main handle flap struck from said top wall and foldably joined thereto along at least a pair of fold lines, and at least one minor handle flap struck in part from said top wall and in part from said main handle flap, said minor handle flap being foldably joined to said top wall along a single fold line spaced transversely from said pair of fold lines, said main handle flap and said minor handle flap being inwardly folded to cause said minor handle flap to be in flat face contacting relation with said major flap and with the inner surface of said top wall to form a triple thickness handle structure.

2. Handle structure according to claim 1 wherein said pair of fold lines are spaced transversely outward from said single fold line.

3. Handle structure according to claim 1 wherein said main handle flap comprises a plurality of longitudinally spaced projections foldably joined to said top wall along at least a pair of fold lines, and a plurality of minor handle flaps interspersed between said longitudinally spaced projections and foldably joined to said main handle flap along fold lines which are spaced transversely inward relative to said pair of fold lines.

4. Handle structure according to claim 1 wherein a longitudinal medial strut is formed in said top wall and wherein a main handle flap and a minor handle flap are disposed on opposite sides of said medial strut.

5. A handle according to claim 1 wherein said main handle flap is normally secured in coplanar relationship with said top wall by severable means and is manually movable inwardly in coordination with rupture of said severable means.

6. A handle according to claim 1 wherein said top wall comprises a pair of face contacting panels foldably joined respectively to the top edges of said side walls and secured together in flat face contacting relation and wherein a reinforcing strip is struck from the inner one of said face contacting panels and secured in flat face contacting relation with the inner surface of said inner one of said face contacting panels to form a three ply medial reinforcing strut for said top wall of the carrier.

7. A handle according to claim 6 wherein a main handle flap and an associated minor handle flap are disposed on opposite sides of said reinforcing strut.

8. A handle according to claim 6 wherein said three ply reinforcing strut in combination with one of said main handle flaps and an associated one of said minor handle flaps forms a five ply handle structure.

9. A handle according to claim 6 wherein the portion of said inner one of said face contacting panels to which said reinforcing strip is secured, the portion of the outer one of said face contacting panels which overlies said reinforcing strip, together with a main handle flap on one side of said strut, and a minor handle flap on said one side of said strut, said main and said minor handle flaps being foldably joined to said strut along fold lines which are spaced different distances from said strut to form a five ply handle structure.

* * * * *